US006681694B2

(12) United States Patent
Schneider et al.

(10) Patent No.: US 6,681,694 B2
(45) Date of Patent: Jan. 27, 2004

(54) WEB-FED ROTARY PRINTING MACHINE

(75) Inventors: Josef Schneider, Diedorf (DE); Rainer Stamme, Augsburg (DE); Godber Petersen, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 7 days.

(21) Appl. No.: 10/058,933

(22) Filed: Jan. 28, 2002

(65) Prior Publication Data

US 2002/0100381 A1 Aug. 1, 2002

(30) Foreign Application Priority Data

Jan. 27, 2001 (DE) ..... 101 03 631

(51) Int. Cl.[7] ..... B41F 13/30; B41F 13/24

(52) U.S. Cl. ..... 101/228; 101/219; 101/248; 101/145

(58) Field of Search ..... 101/143, 138, 101/139, 219, 217, 218, 248, DIG. 35, 228, 145

(56) References Cited

U.S. PATENT DOCUMENTS

| | | | | |
|---|---|---|---|---|
| 3,986,454 A | * 10/1976 | Granger | 101/216 |
| 4,141,293 A | 2/1979 | Corse | 101/181 |
| 5,564,336 A | * 10/1996 | Straubinger et al. | 101/152 |
| 5,806,427 A | 9/1998 | Niemiro et al. | 101/247 |
| 5,868,071 A | 2/1999 | Niemiro et al. | 101/218 |
| 6,085,650 A | 7/2000 | Petersen | 101/220 |
| 6,186,065 B1 | 2/2001 | Kersch et al. | 101/216 |
| 6,397,743 B1 | * 6/2002 | Dauer et al. | 101/220 |
| 6,408,754 B2 | * 6/2002 | Siler et al. | 101/401.1 |
| 6,494,135 B1 | * 12/2002 | Gottling et al. | 101/213 |
| 2002/0078839 A1 | * 6/2002 | Walczak et al. | 101/217 |

FOREIGN PATENT DOCUMENTS

| | | | |
|---|---|---|---|
| CA | 2316020 A1 * | 2/2001 | B41F/13/20 |
| DE | 93 06 369 | 12/1993 | |
| DE | 195 34 651 | 3/1997 | |
| DE | 196 24 395 | 1/1998 | |
| DE | 100 08 225 | 2/2001 | |
| DE | 199 37 783 | 2/2001 | |
| DE | 199 37 803 | 2/2001 | |
| DE | 199 37 805 | 2/2001 | |
| EP | 0 113 601 | 7/1984 | B41F/13/44 |
| WO | 99/10176 | 3/1999 | |

OTHER PUBLICATIONS

Deutscher Drucker Nr. 18/11.5.2000, "Dicoweb" by MAN Roland Druckmaschinen AG, Augsburg 2000.

* cited by examiner

*Primary Examiner*—Daniel J. Colilla
(74) *Attorney, Agent, or Firm*—Cohen, Pontani, Lieberman & Pavane

(57) ABSTRACT

In order to provide a rotary printing machine for direct printing, in which the printing-assembly cylinders are guided in a stable manner by means of a cost-effective device, the forme cylinder and the impression cylinder of a printing assembly are mounted, adjustably in terms of their mutual spacing, in side walls. At least one of the two cylinders is mounted on both sides in slides movable on straight guide elements which are arranged in each case on at least one of two opposite panels of an aperture in the side walls.

28 Claims, 8 Drawing Sheets

WEB-FED ROTARY PRINTING MACHINE

BACKGROUND OF THE INVENTION

1. Field of the Invention

The invention relates to a web-fed rotary printing machine with at least one printing unit having at least one printing assembly which contains, arranged one above the other, a forme cylinder and an impression cylinder.

2. Description of the Related Art

DE 195 34 651 A1 shows a printing assembly for a rotary printing machine for indirect printing. Four printing-assembly cylinders are arranged one above the other, the journal mountings of which are capable of being clamped in jaws which are mounted movably on side walls by means of slides. The cylinders are accessible on the end face through an orifice in the side wall after the jaws have been moved away. The cylinders can then be equipped with sleeves having a different outside diameter. This design involves a relatively complicated construction.

According to U.S. Pat. No. 6,085,650 printing-assembly cylinders are mounted in slides which are displaceable on columns. Here, in each case, two cylinders can be positioned in such a way that they co-operate in direct intaglio printing. The columns must have sturdy dimensioning in order to achieve high stability.

The brochure "Dicoweb" by MAN Roland Druckmaschinen AG, Augsburg, 2000, shows printing units of a web-fed rotary printing machine, in which printing-assembly cylinders of a double printing assembly for rubber-to-rubber offset printing are mounted on both sides in slides. The slides are displaceable on guides which are fastened in each case to opposite panels of an aperture in side walls.

SUMMARY OF THE INVENTION

The object of the invention is to provide a rotary printing machine for direct printing, in which the printing-assembly cylinders are guided in a stable manner by means of a cost-effective device.

According to the invention, each printing unit includes a pair of side walls, each side wall including an aperture flanked by a pair of mutually facing panels The forme cylinder is driven by its own drive motor, and at least one of the cylinders has both of its ends mounted in slides moveable on straight guide elements arranged on at least one panel of each aperture. By the printing-assembly cylinders being mounted on the panels of the apertures of the side walls, a direct vertical introduction of the supporting forces for the printing-assembly cylinders into the side walls in their longitudinal direction takes place. The support therefore has high rigidity and low vibration, this being a precondition for a good print quality. High forces can be applied. The device is simple in structural terms and can therefore be produced cost-effectively. Thus, for example, the guide elements can be implemented by means of commercially available straight guides. The printing units are also distinguished by a compact space-saving form of construction.

Thus, printing can be carried out selectively by the intaglio printing method or the flexographic printing method by means of one and the same printing machine, and the machine can be changed over in a simple way from one method to the other. Both printing methods may also be used simultaneously. The printing machine manufacturer can produce the machines for both methods identically from the same components, thus making cost-effective manufacture possible. The printing machines can also be produced with a variable format, that is to say they can be converted in a simple way to other formats, that is to say other diameters of the printing-assembly cylinders and cut-off lengths. Furthermore, the printing machine can be changed over quickly to various production variants.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
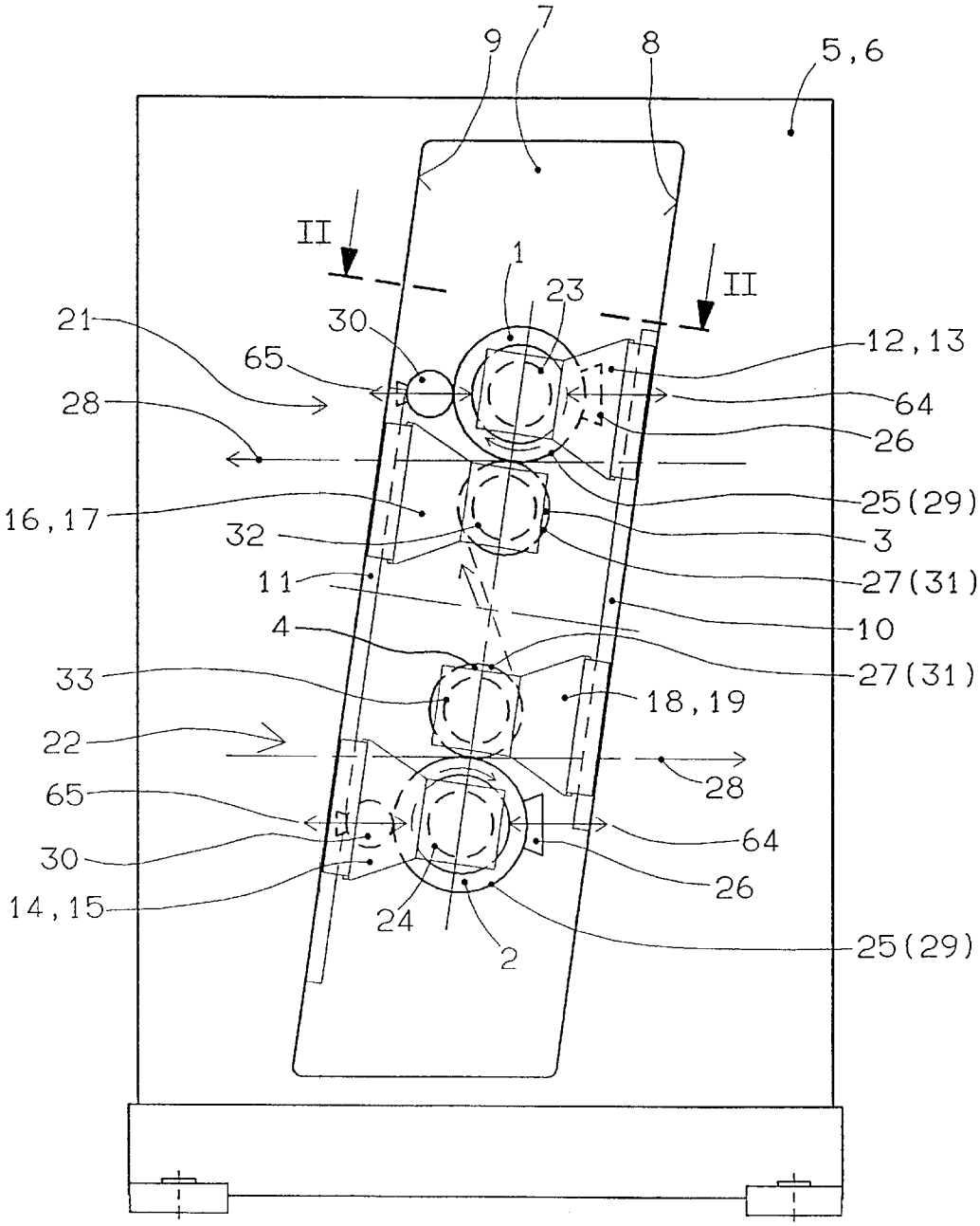
FIG. 1 shows an intaglio printing unit in a side view.

FIG. 1 shows a printing unit of a web-fed rotary printing machine with two forme cylinders 1, 2 and two impression cylinders 3, 4 which are mounted altogether, on each of the two sides, in a side wall 5, 6. Each side wall 5, 6 has an aperture 7 which is delimited by opposite panels 8, 9. The aperture 7 may also be designed, for example, as an open slot. Straight guide elements 10, 11 are arranged on the panels 8, 9.

Figure 2:
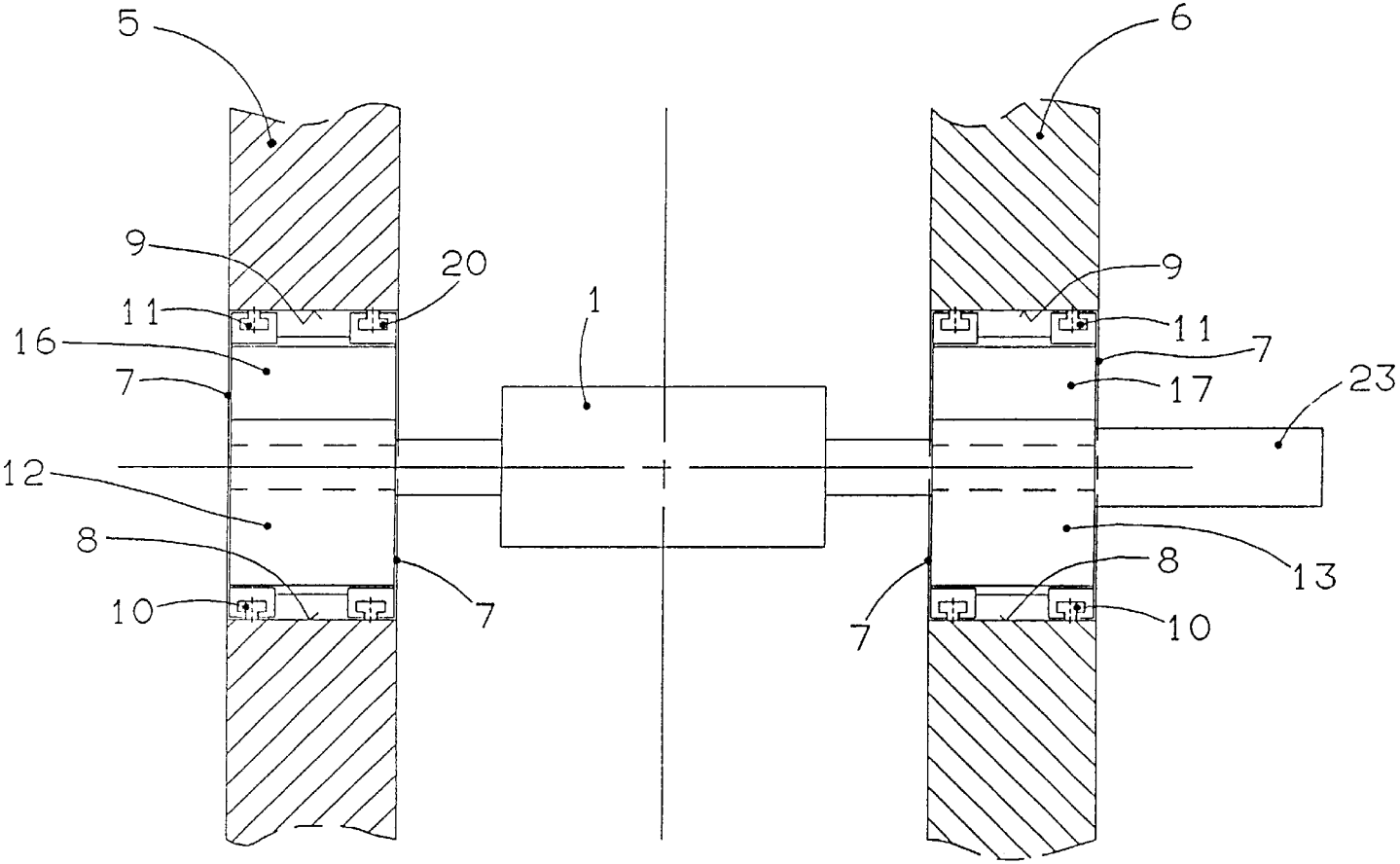
FIG. 2 shows the section II—II according to FIG. 1.

Each forme cylinder 1, 2 is mounted on each of the two sides, by means of its journal, in a slide 12 to 15. The impression cylinders 3, 4 are likewise mounted on each of their two sides in a slide 16 to 19. The slides 12 to 19 are mounted movably on the guide elements 10, 11 (FIG. 2). In order to provide a form-fitting slide guide, the guide elements 10, 11 have a T-shaped cross section, the crosshead of which engages into a correspondingly designed undercut channel 20 on each slide 12 to 19. For the purpose of movability, each slide 12 to 19 possesses a threaded nut which co-operates with a drivable threaded spindle mounted in the respective side wall 5, 6. These elements are not illustrated in the present application. They are described in DE 100 08 225.4, which corresponds to U.S. Pat. No. 6,397,743, which is incorporated herein by reference.

The forme cylinder 1 constitutes, with the impression cylinder 3, a printing assembly 21, and the forme cylinder 2, with the impression cylinder 4, a printing assembly 22 for direct printing. Each forme cylinder 1, 2 is driven by its own drive motor 23, 24, advantageously by a variable-position electric motor. Drive motors 32, 33 are also advantageously provided on the impression cylinders 3, 4, but are not connected up in the configuration shown. They may also be separated in drive terms from the impression cylinders 3, 4 by means of couplings. The impression cylinders 3, 4 are therefore driven by friction. On the other hand, it is also possible for them to be driven by means of the drive motors 32, 33.

The forme cylinders 1, 2 each carry a sleeve-shaped intaglio printing forme 25, onto which an intaglio inking assembly 26 can be thrown. Each impression cylinder 3, 4 carries a sleeve 27 with an elastic outer surface, so that the impression cylinders 3, 4 constitute elastic counterpressure cylinders, also called pressers. In the thrown-on state of the forme and impression cylinders 1, 3 and 2, 4, the printing assemblies 21, 22 print a web 28 in each case on one side, and, with regard to the indicated direction of rotation of the forme cylinders 1, 2 driven by the drive motors 23, 24, the web 28 runs in each case in the direction indicated. The web 28 can also be led from one printing assembly 22, 21 to the other printing assembly 21, 22, the web 28 being printed in one colour on both sides during the web run depicted by broken lines. In this case, the intaglio inking assemblies 26 thrown onto the forme cylinders 1, 2 ink the respective intaglio printing forme 25. Chamber-type doctor blades are advantageously used. The mutual throw-on and throw-off of the forme and impression cylinders 1, 3, and 2, 4 are carried out by means of the movement of the slides 12 to 19, carrying them, on the guide elements 10, 11, the movement of only one cylinder, for example the forme cylinder 1, 2, also being sufficient. The exchange of one intaglio printing forme 25 for another intaglio printing forme 25 is carried out by the forme cylinder 1, 2 being exposed on the operating side, its sleeve-shaped intaglio printing forme 25 being drawn off and another forme sleeve being pushed on. For this purpose, its journal is separated from the cylinder body and, remaining in the slide 12, is moved, together with the latter, out of the circumferential region of the forme cylinder 1, 2 on the guide elements 10. Such a separation of the journal and the forme cylinder 1, 2 is described in U.S. Pat. No. 6,186,065, which is incorporated herein by reference. After the exchange of the printing forme, the slide 12, 14 is moved into the region of the forme cylinder 1, 2 again, until its journal is in alignment with the forme cylinder 1, 2. The journals are subsequently connected to the forme cylinder 1, 2 again.

The printing unit 21 equipped for intaglio printing can be converted in a simple way for flexographic printing. For this purpose, in the way described, the sleeve-shaped intaglio printing forme 25 is drawn off from the forme cylinder 1 and a sleeve-shaped flexographic printing forme 29 is pushed on. Furthermore, a flexographic inking assembly 30 is thrown onto the forme cylinder 1. The printing assembly 22 can likewise be equipped with a flexographic printing forme 29 and a flexographic inking assembly 30 be thrown onto the latter. The inking assembly is advantageously designed with a chamber-type doctor blade and with an engraved roller. Moreover, during the changeover of the printing assemblies 21, 22, the sleeves 27 with an elastic outer surface are drawn off from the impression cylinders 3, 4 and are replaced by sleeves 31 with a non-elastic outer surface. The exchange of the sleeve on the impression cylinder 3, 4 takes place in a similar way to the change of forme on the forme cylinder 1, 2. Thus, the impression cylinder 3, 4 is exposed at the operating-side mounting, in that its journal, together with the slides 16, 18, is moved away from the region of the impression cylinder 3, 4. By means of the changed-over printing assemblies 21, 22, a web 28 can then be printed in each case on one side by the flexographic printing method. In the way described, a printing assembly equipped for flexographic printing can also be converted to intaglio printing. Sleeves having another outside diameter can also be attached to the forme cylinder 1, 2, with the result that the forme cylinder 1, 2 is changed in diameter and therefore the printing format is changed. To set the resulting different spacing of the forme and impression cylinders 1, 3, 2, 4, the forme cylinders 1, 2 or impression cylinders 3, 4 or all the cylinders 1 to 4 are moved on the guide elements 10, 11.

The intaglio inking assembly 26 and the flexographic inking assembly 30 are fastened to the slides 12, 13 and 14, 15. Depending on the printing method selected, the intaglio inking assembly 26 or the flexographic inking assembly 30 is suspended in the slides 12 to 15 or both inking assemblies 26, 30 are advantageously inserted into the slides 12 to 15 simultaneously. By virtue of this inking-assembly fastening, in the event of a change in the diameter of the forme cylinder 1, 2 with an accompanying change in spacing in relation to the impression cylinder 3, 4, the inking assemblies 26, 30 are also brought into the correct position at the same time as the displacement of the forme cylinder 1, 2 into the new position. Furthermore, for diameter adaptation and throw-on and throw-off, the inking assemblies 26, 30 are displaceable in an approximately horizontal direction by means of movement devices 64, 65. In the event that the forme cylinders 1, 2 are not arranged movably, the inking assemblies 26, 30 are arranged in a predetermined vertical position and are displaceable only by means of the movement devices 64, 65.

Figure 3:
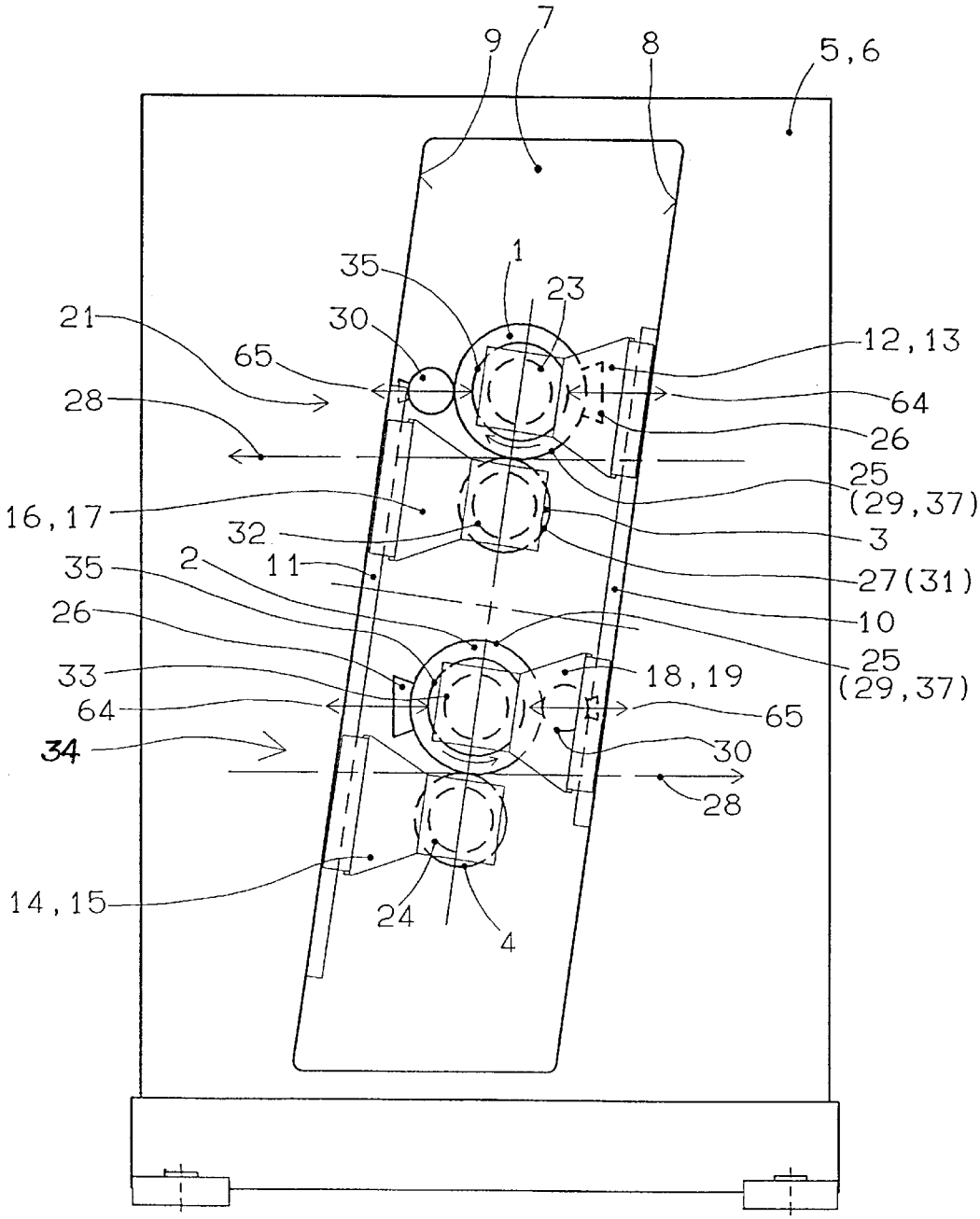
FIG. 3 shows a flexographic design variant to FIG. 1.

In the further exemplary embodiments, for the sake of simplicity, the previous reference symbols are as far as possible retained for identical or similar components. FIG. 3 shows a printing unit which, in an identical way to FIG. 1, again contains the printing assembly 21. Its forme cylinder 1 is mounted on both sides in slides 12, 13 and its impression cylinder 3 in slides 16, 17. The slides 12, 13 and 16, 17 are movable on respective guide elements 10 and 11 which are fastened to panels 8, 9 of orifices 7 in the side walls 5, 6.

The printing assembly 34 was produced by conversion of the printing assembly 22 from FIG. 1. For this purpose, the sleeve 27 carrying a counterpressure surface was drawn off from the body of the impression cylinder 4 and the sleeve-shaped intaglio printing forme 25 pushed on and the impression cylinder 4 was thus converted to the forme cylinder 2. A similar procedure was adopted for the forme cylinder 2 of the printing assembly 22 in FIG. 1, that is to say its sleeve-shaped intaglio printing forme 25 was drawn off and a sleeve 27 with a counterpressure surface, here an elastic outer surface, was pushed on. The forme cylinder 2 of the printing assembly 22 in FIG. 1 was consequently converted so as to function as an impression cylinder 4. The forme cylinder 2 is mounted in the slides 18, 19 and the impression cylinder 4 in the slides 14, 15 which again are movable on the guide elements 10, 11. An intaglio inking assembly 26 in the form of a chamber-type doctor blade can be thrown onto each forme cylinder 1, 2. The forme cylinders 1, 2 are driven in each case by means of a drive motor 23, 33, and, in the direction of rotation indicated, the two printing assemblies 21, 34 print a web 28 on one side, in each case with the impression cylinder 3, 4 thrown on. The printing assemblies 21, 34 may also be operated in the other direction of rotation, in which case the web 28 is in each case led through the printing assemblies 21, 34 in the opposite direction. The drive motors 32, 24 of the impression cylinders 3, 4 are switched off, so that the latter rotate only by virtue of frictional take-up. The drive motors 32, 24 may, however, also drive the impression cylinders 3, 4.

It is also possible, for example, for sleeve-shaped flexographic printing formes 29 to be attached to the forme cylinders 1, 2, in which case the respective flexographic inking assembly 30 is then thrown onto these flexographic printing formes. Also, the cylinder body 35 carrying the sleeve-shaped printing formes 25, 29 can be extracted from the forme cylinders 1, 2 and replaced by a cylinder body 37, on the outer surface of which a printing forme is applied. These variants are also indicated in FIG. 3 by reference symbols placed in brackets. The complete forme cylinder 1, 2, together with its journal, may also be extracted from the printing unit and exchanged for another with an intaglio or flexographic printing forme or for an impression cylinder.

It is also possible, in the case of the printing assemblies 21, 34, in each case to design only one cylinder so as to be movable on the guide elements 10, 11, for example the forme cylinder 1, 2, in which case the impression cylinders 3, 4 can be mounted in bearing plates which are screwed (not illustrated) to the panel 9. Where the non-displaceably positioned impression cylinder is concerned, the height of the web plane does not alter in the event of a format change.

Figure 4:
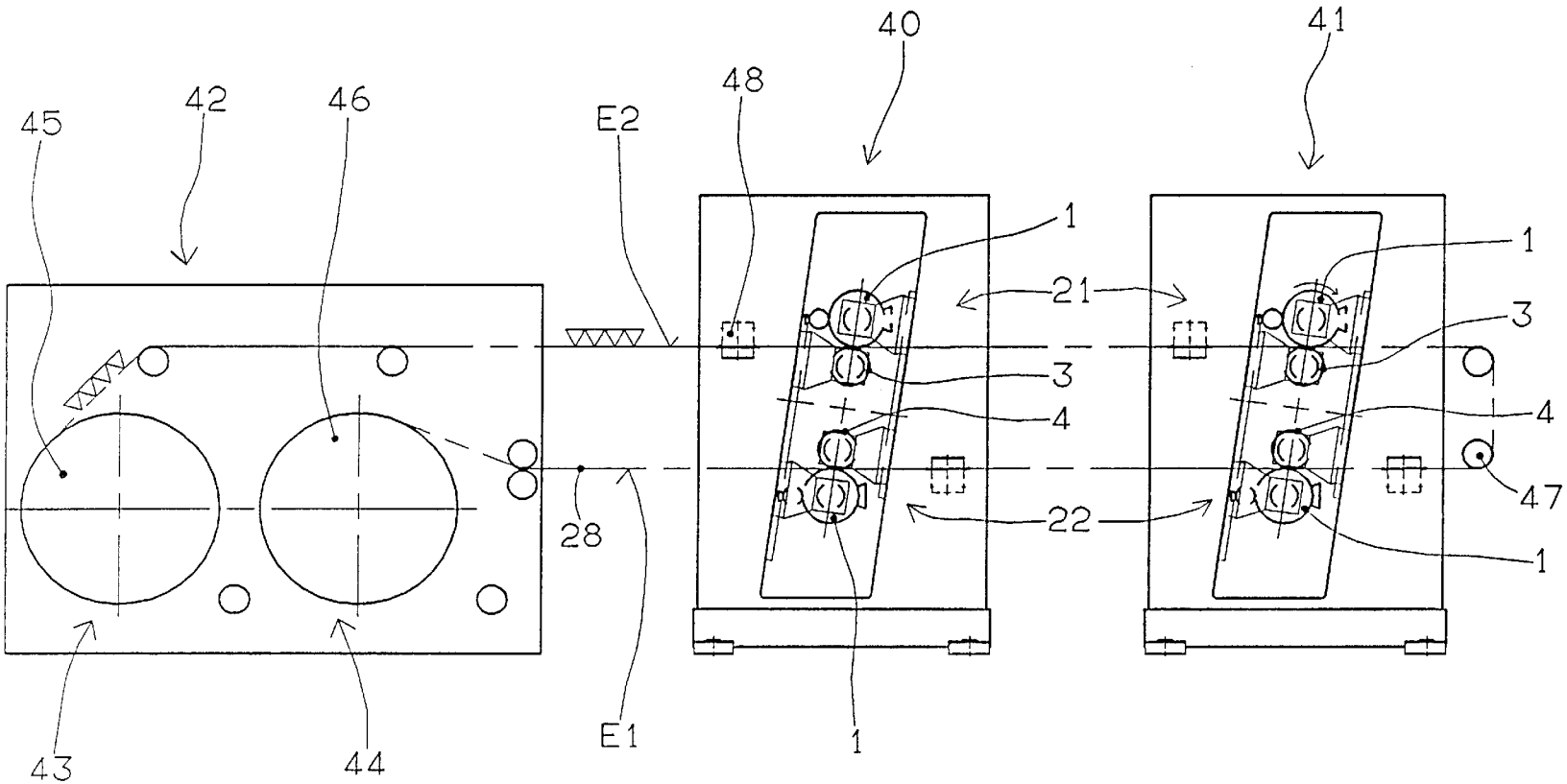
FIGS. 4 and 5 show a printing machine with two printing units with two production variants.
Figure 5:
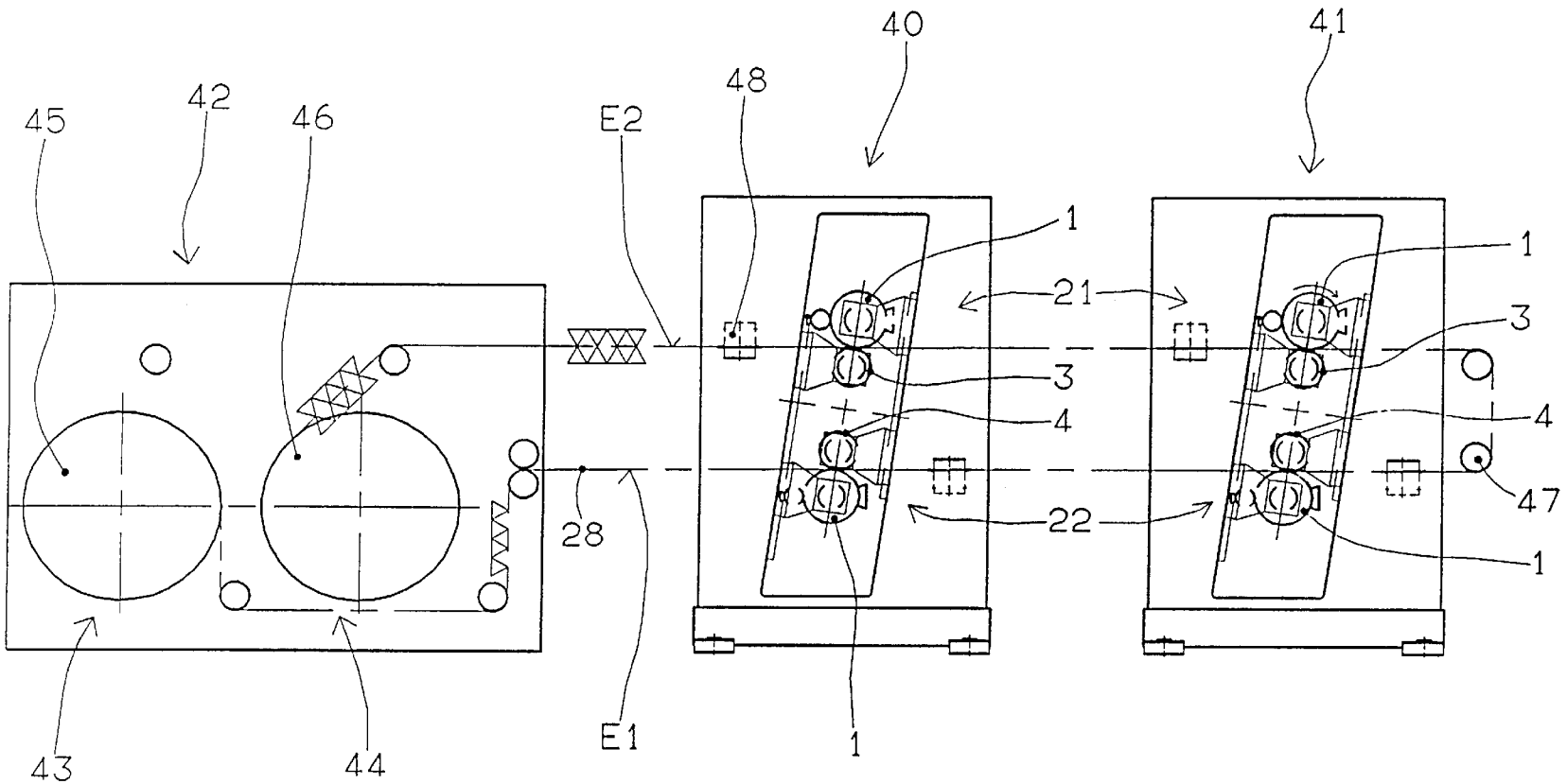

Some printing machine configurations, using the printing assemblies described, will be presented below. FIGS. 4 and 5 show a web-fed rotary printing machine with two printing units 40, 41 which each contain two printing assemblies 21, 22, as presented in FIG. 1. The forme cylinders 1 carry, for example, sleeve-shaped intaglio printing formes. The printing assemblies 21, 22 are arranged in the printing units 40, 41 in each case in such a way that the impression cylinders 3, 4 are adjacent.

Arranged next to the printing units 40, 41 is a winding device 42 which contains two reeling devices 43, 44. A winding reel 45, 46 can be clamped into each reeling device 43, 44, and the reeling devices 43, 44 can operate in the unwinding and the winding-up mode.

According to FIG. 4, a web 28 is unwound from the winding reel 46 by the reeling device 44. The web 28 is first led in a plane E1 through the lower printing assemblies 22, at the same time printed on one side with two colours, subsequently deflected via guide rollers 47 and led into the other plane E2 where it is printed on the same side of the web with two further colours by the upper printing assemblies 21. The web 28, then printed in four colours, is wound onto the winding reel 45 by means of the reeling device 43. A drying device 48 directed onto the printed side of the web 28 is arranged downstream of each printing assembly 21, 22 in the web running direction, the result of this being that the respective print is dried and smudging is avoided.

FIG. 5 shows the further processing of the web 28 wound up to form the winding reel 45, by means of the same web-fed rotary printing machine as that shown in FIG. 4. The reeling device 43 in this case operates as an unwinding device, from which the web 28 printed in four colours on one side is unwound and led via guide rollers in the one plane E1 through the printing assemblies 22 and is printed with two colours in verso printing. The web 28 is subsequently brought into the other plane E2 via guide rollers 47 and led in the opposite direction through the printing assemblies 21 and is printed with a further two colours in verso printing. The web 28, then printed in four colours on each of the two sides, is wound onto the winding reel 46 in the reeling device 44.

Figure 6:
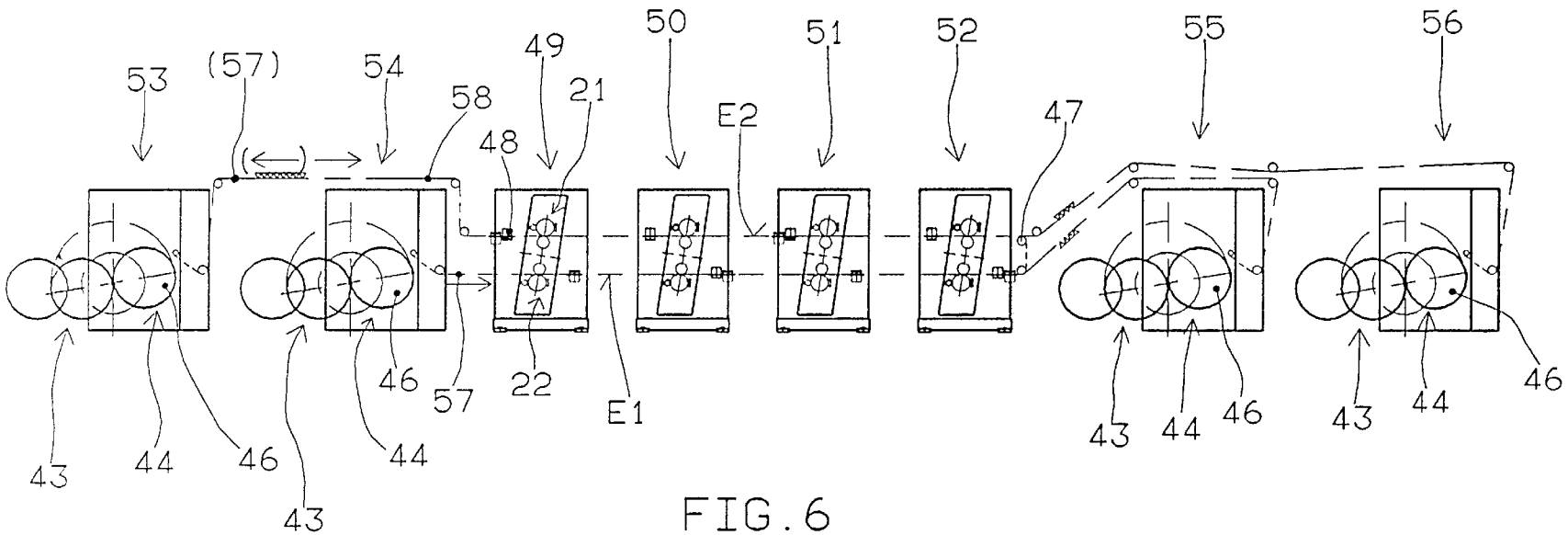
FIG. 6 shows a printing machine with four printing units and four winding devices.

FIG. 6 shows a web-fed rotary printing machine with four printing units 49 to 52 which are preceded by two winding devices 53, 54 and followed by two winding devices 55, 56. Each winding device 53 to 56 contains two reeling devices 43, 44 which can be operated selectively as a winding-up or unwinding device. Each printing unit 49 to 52 contains two printing assemblies 21, 22, as illustrated in FIG. 1 and described.

A web 57 is unwound from a winding reel 46 by the reeling device 44 of the winding device 54, said reeling device operating in the unwinding mode, and is led in the one plane E1 through the printing assemblies 22 of the printing units 49 to 52 and finally, printed in four colours on one side, is wound up in the reeling device 44 of the winding device 55 to form the winding reel 46. A further web 58 is unwound from the winding reel 46 of the reeling device 44 of the winding device 53 and is led in the other plane E2 through the printing assemblies 21 of the printing units 49 to 52 and at the same time likewise printed in four colours on one side. The printed web 58 is subsequently led to the winding device 56 and wound onto the winding reel 46 in the reeling device 44 operating in the winding-up mode.

In another production variant, the web 57 printed in four colours on one side in the plane E1 may also be led to the other plane E2 via guide rollers 47 and guided in the opposite direction through the printing assemblies 21 of the printing units 49 to 52, the web 57 then being printed in eight colours on one side. The web 57 is finally wound onto the winding reel 46 by the reeling device 44 of the winding device 53. This production variant is also indicated in FIG. 6 by the reference numeral 57 placed in brackets. By means of the printing machine configuration shown in FIG. 6, therefore, selectively two webs can each be printed in four colours on one side or one web can be printed in eight colours on one side.

Figure 7:
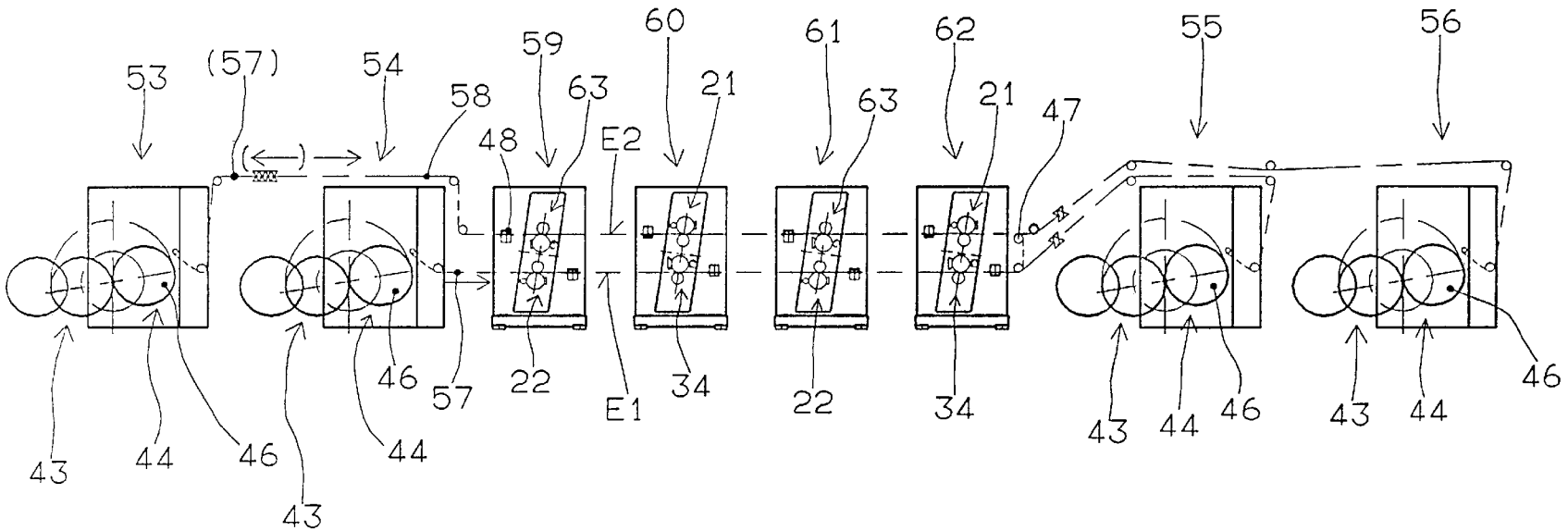
FIG. 7 shows a further design variant to FIG. 6.

FIG. 7 shows a web-fed rotary printing machine with four printing units 59 to 62 which are preceded by two winding devices 53, 54 and followed by two winding devices 55, 56. Each winding device 53 to 56 contains two reeling devices 43, 44 which can be operated selectively as a winding-up or unwinding device. The printing units 60 and 62 are identical to the printing unit shown in FIG. 3. They therefore each contain two printing assemblies 21, 34 in which the forme cylinder is arranged above the impression cylinder. The printing units 59 and 62 each contain a lower printing assembly 22 in which the forme cylinder is arranged below the impression cylinder, as shown in FIG. 1. The printing assembly 62 arranged above it in each case is designed identically to the printing assembly 22, and, therefore, here too, the forme cylinder is arranged below the associated impression cylinder.

A web is unwound from a winding reel 46 by the reeling device 44 of the winding device 54, said reeling device operating in the unwinding mode, and is led in the one plane E1 successively through the printing assemblies 22, 34, arranged in alternating sequence, of the printing units 59 to 62. The web 57 at the same time printed in two colours on both sides is wound in the reeling device 44 of the winding device 55 to form the winding reel 46. A further web 58 is unwound from the winding reel 46 of the reeling device 44 of the winding device 53 and is led in the other plane E2 through the printing assemblies 63, 21 of the printing units 49 to 52 and at the same time likewise printed in two colours on both sides. The printed web 58 is subsequently led to the winding device 56 and wound onto the winding reel 46 in the reeling device 44 operating in the winding-up mode.

In another production variant, the web 57 printed in two colours on both sides in the one plane E1 may also be led via guide rollers 47 to the other plane E2 and be guided in the opposite direction through the printing assemblies 21, 63 of the printing units 62 to 59, the web 57 then being printed in four colours on both sides. The web 57 is finally wound onto the winding reel 46 by the reeling device 44 of the winding device 53. This production variant is also indicated in FIG. 7 by the reference numeral 57 placed in brackets. By means of the printing machine configuration shown in FIG. 7, therefore, selectively two webs can be printed in each case in two colours on both sides or one web can be printed in four colours on both sides. A drying device 48 directed onto the printed side of the web 57, 58 and intended for drying the print made is advantageously provided downstream of each printing assembly 21, 22, 34, 63 in the web running direction.

Figure 8:
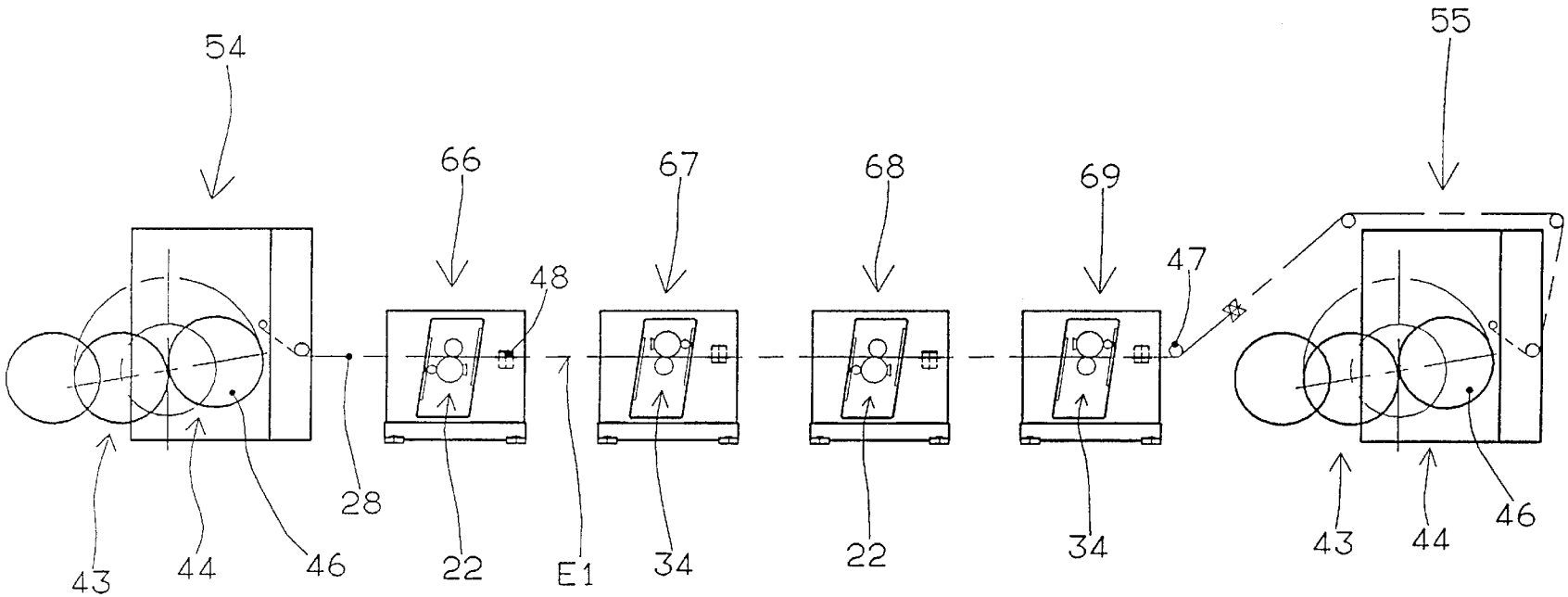
FIG. 8 shows a printing machine with four printing units, each with a printing assembly.

The rotary printing machine illustrated in FIG. 8 contains four printing units 66 to 69, each with a printing assembly 22 or 34. In practice, the printing units 66 to 68 are comparable to the printing unit according to FIG. 1, only the upper printing assembly being dispensed with in the latter. The printing units 67 and 69 are comparable to the printing unit according to FIG. 3, the upper printing assembly being dispensed with in the latter. Printing units 66, 68, in which the forme cylinder is arranged below the impression cylinder, are always arranged one behind the other in alternation with printing units 67, 69, in which the forme cylinder is arranged above the impression cylinder. The rotary printing machine could, instead, also contain only printing units in which the forme cylinder is always arranged above or below the impression cylinder. The printing units 66 to 69 are preceded by a winding device 54 and followed by a winding device 55 which in each case contain two reeling devices 43, 44 capable of being operated selectively as an unwinding or a winding-up device.

A web 28 is unwound from a winding reel 46 by the reeling device 44 of the winding device 54, said reeling device operating in the unwinding mode, and is led in the one plane E1 successively through the printing assemblies 22, 34, arranged in alternating sequence, of the printing units 66 to 69. The web 28 in this case printed in two colours on both sides is wound in the reeling device 44 of the winding device 55 to form the winding reel 46.

In all the printing machine configurations according to FIGS. 3 to 8, a selection can be made between the intaglio or the flexographic printing methods. It is also possible, for example, to use one printing method for recto printing and the other printing method for verso printing, for example, in FIG. 7, the web 57 to be printed on both sides may be printed by the flexographic printing method in recto printing and by the intaglio printing method in verso printing.

The printed webs 28, 57, 58, instead of being wound to form reels, may also be supplied to an open-sheet delivery and delivered in sheet form or be processed into foldable products in a folder.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A web-fed rotary printing machine comprising a plurality of printing units arranged one behind the other in a web running direction, each said printing unit comprising a pair of side walls, each said side wall having an aperture flanked by a pair of mutually facing panels, a printing assembly comprising a forme cylinder and an impression cylinder arranged one above the other and designed for printing a web guided therebetween, said forme cylinder being driven by its own drive motor, each cylinder having a pair of opposed ends, and means for adjusting the mutual spacing between the forme cylinder and the impression cylinder, said means comprising slides in which at both ends of at least one of said forme cylinder and said impression cylinder are mounted, at least one of said cylinders having both of said ends mounted in slides moveable on guide elements arranged on at least one panel of each said aperture, wherein said printing assemblies comprise printing assemblies wherein said forme cylinder is arranged above said impression cylinder alternating in said web running direction with printing assemblies wherein said impression cylinder is arranged above said forme cylinder.

2. A web-fed rotary printing machine as in claim 1 wherein said forme cylinder carries one of an intaglio printing forme onto which an intaglio inking assembly can be thrown, and a flexographic printing forme onto which a flexographic inking assembly can be thrown.

3. A web-fed rotary printing machine as in claim 2 wherein said forme cylinder carries a sleeve-shaped printing forme which can be exchanged for a printing forme having a different outside diameter.

4. A web-fed rotary printing machine as in claim 1 wherein said forme cylinder carries a cylinder body which carries a sleeve-shaped printing forme, said cylinder body being exchangeable for a cylinder body having a different outside diameter.

5. A web-fed rotary printing machine as in claim 1 wherein said forme cylinder carries a printing forme which can be exchanged for one of a sleeve with a counter-pressure surface and a cylinder body with a counter-pressure surface.

6. A web-fed rotary printing machine as in claim 1 wherein said impression cylinder carries one of a sleeve and a cylinder body with a counter-pressure surface, said one being exchangeable for a printing forme.

7. A web-fed rotary printing machine as in claim 1 wherein a web printed on one side can be guided through said printing assemblies.

8. A web-fed rotary printing machine as in claim 1 further comprising a drying device directed toward a printed side of the web arranged downstream of each printing assembly in the web-running direction.

9. A web-fed rotary printing machine as in claim 1 further comprising a web winding devices arranged upstream and downstream of the printing units in the web running direction.

10. A web-fed rotary printing machine as in claim 1 wherein each said printing assembly comprises an inking assembly which is moveable in the direction of the guide elements.

11. A web-fed rotary printing machine as in claim 1 wherein each said printing assembly comprises an inking assembly which is moveable in an approximately horizontal direction with respect to the forme cylinder.

12. A web-fed-rotary printing machine as in claim 1 wherein each said impression cylinder can be driven by an electric motor which can be one of switched off and uncoupled.

13. A web-fed rotary printing machine as in claim 1 wherein each said forme cylinder has an outside diameter which can be changed.

14. A web-fed rotary printing machine comprising a plurality of printing units arranged one behind the other in a web running direction, each said printing unit comprising a pair of side walls, each said side wall having an aperture flanked by a pair of mutually facing panels, a first printing assembly comprising a forme cylinder and an impression cylinder arranged one above the other and designed for printing a web guided therebetween in a first plane, said forme cylinder being driven by its own drive motor, each cylinder having a pair of opposed ends, a second printing assembly comprising a forme cylinder and an impression arranged one above the other and designed for printing a web guided therebetween in a second plane, which is below said first plane, said forme cylinder being driven by its own drive motor, each cylinder having a pair of opposed ends, guide rollers for guiding said web from said first plane to said second plane, and means for adjusting the mutual spacing between the forme cylinder and the impression cylinder of each said printing assembly, said means comprising slides in which at both ends of at least one of said forme cylinder and said impression cylinder are mounted, at least one of said cylinders having both of said ends mounted in slides moveable on guide elements arranged on at least one panel of each said aperture.

15. A web-fed rotary printing machine as in claim 14, wherein each said forme cylinder carries one of an intaglio printing forme onto which an intaglio inking assembly can be thrown, and a flexographic printing forme onto which a flexographic inking assembly can be thrown.

16. A web-fed rotary printing machine as in claim 15 wherein said forme cylinder carries a sleeve-shaped printing forme which can be exchanged for a printing forme having a different outside diameter.

17. A web-fed rotary printing machine as in claim 14 wherein said forme cylinder carries a cylinder body which carries a sleeve-shaped printing forme, said cylinder body being exchangeable for a cylinder body having a different outside diameter.

18. A web-fed rotary printing machine as in claim 14 wherein said forme cylinder carries a printing forme which can be exchanged for one of a sleeve with a counter-pressure surface and a cylinder body with a counter-pressure surface.

19. A web-fed rotary printing machine as in claim 14 wherein said impression cylinder carries one of a sleeve and a cylinder body with a counter-pressure surface, said one being exchangeable for a printing forme.

20. A web-fed rotary printing machine as in claim 14 wherein a web printed on one side can be guided through said printing assemblies.

21. A web-fed rotary printing machine as in claim 14 wherein said printing assemblies comprise printing assemblies wherein said forme cylinder is arranged above said impression cylinder alternating with printing assemblies wherein said impression cylinder is arranged above said forme cylinder.

22. A web-fed rotary printing machine as in claim 14 wherein said impression cylinders of said first printing assemblies are adjacent to said impression cylinders of said second printing assemblies.

23. A web-fed rotary printing machine as in claim 14 further comprising a drying device directed toward a printed side of the web arranged downstream of each printing assembly in the web-running direction.

24. A web-fed rotary printing machine as in claim 14 further comprising a web winding devices arranged upstream and downstream of the printing units in the web running direction.

25. A web-fed rotary printing machine as in claim 14 wherein each said printing assembly comprises an inking assembly which is moveable in the direction of the guide elements.

26. A web-fed rotary printing machine as in claim 14 wherein each said printing assembly comprises an inking assembly which is moveable in an approximately horizontal direction with respect to the forme cylinder.

27. A web-fed-rotary printing machine as in claim 14 wherein each said impression cylinder can be driven by an electric motor which can be one of switched off and uncoupled.

28. A web-fed rotary printing machine as in claim 14 wherein each said forme cylinder has an outside diameter which can be changed.

* * * * *